US005250212A

United States Patent [19]

de Buzzaccarini et al.

[11] Patent Number: 5,250,212

[45] Date of Patent: Oct. 5, 1993

[54] LIQUID DETERGENT CONTAINING SOLID PEROXYGEN BLEACH AND SOLVENT SYSTEM COMPRISING WATER AND LOWER ALIPHATIC MONOALCOHOL

[75] Inventors: Francesco de Buzzaccarini, Brussels; Jean P. Boutique, Ernage, both of Belgium

[73] Assignee: The Procter & Gamble Company, Cincinnati, Ohio

[21] Appl. No.: 9,362

[22] Filed: Jan. 26, 1993

Related U.S. Application Data

[63] Continuation of Ser. No. 870,722, Apr. 13, 1992, abandoned, which is a continuation of Ser. No. 420,653, Oct. 11, 1989, abandoned, which is a continuation of Ser. No. 197,874, May 24, 1988, abandoned.

[30] Foreign Application Priority Data

May 27, 1987 [GB] United Kingdom ..... 8712430

[51] Int. Cl.[5] ..... C11D 7/38; C11D 7/54

[52] U.S. Cl. ..... 252/104; 252/94; 252/95; 252/99; 252/103; 252/158; 252/162; 252/186.1; 252/186.42; 252/186.43

[58] Field of Search ..... 252/94, 95, 99, 103, 252/104, 158, 162, 186.1, 186.42, 186.43

[56] References Cited

U.S. PATENT DOCUMENTS

| | | | |
|---|---|---|---|
| 3,764,281 | 10/1973 | Biasotti | 585/14 |
| 3,773,479 | 11/1973 | Dorn et al. | 252/392 |
| 3,948,800 | 4/1976 | Meinhardt | 252/357 |
| 4,144.034 | 3/1979 | Cummings | 252/392 |
| 4,207,079 | 6/1980 | Herbstman et al. | 252/392 |
| 4,240,920 | 12/1980 | De Luque | 252/95 |
| 4,290,778 | 9/1981 | Herbstman et al. | 252/392 |
| 4,321,060 | 3/1982 | Sung et al. | 252/392 |
| 4,321,062 | 3/1982 | Herbstman et al. | 252/392 |
| 4,347,149 | 8/1982 | Smith et al. | 252/103 |
| 4,377,489 | 3/1983 | King | 252/99 |
| 4,391,610 | 7/1983 | Sung et al. | 252/392 |
| 4,419,105 | 12/1983 | Sung | 252/392 |
| 4,444,566 | 4/1984 | Crawford et al. | 252/403 |
| 4,460,379 | 7/1984 | Sweeney et al. | 252/403 |
| 4,522,739 | 6/1985 | Gray | 252/103 |
| 4,581,040 | 4/1986 | Sung et al. | 44/407 |
| 4,631,069 | 12/1986 | Sung | 44/407 |
| 4,643,738 | 2/1987 | Sung et al. | 44/407 |
| 4,676,917 | 6/1987 | Sung et al. | 252/51.5 R |
| 4,689,051 | 8/1987 | Sung | 44/407 |
| 4,747,851 | 5/1988 | Sung et al. | 525/404 |

FOREIGN PATENT DOCUMENTS

| | | |
|---|---|---|
| 0037184 | 10/1981 | European Pat. Off. . |
| 0086511 | 8/1983 | European Pat. Off. . |
| 3609345 | 3/1985 | Fed. Rep. of Germany . |
| 3511515 | 10/1985 | Fed. Rep. of Germany . |
| 3519689 | 12/1986 | Fed. Rep. of Germany . |
| 2579615 | 10/1986 | France . |
| 2158838 | 11/1985 | United Kingdom . |
| 2173224 | 10/1986 | United Kingdom . |

OTHER PUBLICATIONS

U.S. application Ser. No. 205,985, filed Jun. 13, 1988.

"Texaco's Jeffamine D Series. Their Flexible Backbone Adapts to a Wide Range of Applications", Texaco Chemical Company.

"The Jeffamine Polyoxyalkyleneamines", Texaco Chemical Company.

*Primary Examiner*—Paul Lieberman
*Assistant Examiner*—Bradley A. Swope
*Attorney, Agent, or Firm*—Mary P. McMahon; Kathleen M. Harleston; Fernando A. Borrego

[57] ABSTRACT

Solid peroxygen bleach containing aqueous liquid detergent compositions having a pH of at least 8 are disclosed. The peroxygen bleach is water-soluble.

The liquid detergent composition comprises a solvent system comprising water and a water-miscible solvent. The solvent system provides sufficient solubility of anionic surfactants, while keeping the solubility of the peroxygen bleach compound within defined limits.

6 Claims, No Drawings

LIQUID DETERGENT CONTAINING SOLID PEROXYGEN BLEACH AND SOLVENT SYSTEM COMPRISING WATER AND LOWER ALIPHATIC MONOALCOHOL

This is a continuation of application Ser. No. 07/870,722, filed on Apr. 13, 1992, now abandoned, which is a continuation of Ser. No. 07/420,653, filed Oct. 11, 1989, now abandoned, which is a continuation of Ser. No. 07/197,874 filed May 24, 1984, now abandoned.

The present invention relates to liquid detergent compositions which contain a solid, water-soluble peroxygen bleach compound. The compositions herein contain a solvent system comprising water and a water-miscible organic solvent. The solvent system is designed to keep the amount of available oxygen in solution below 0.5%, preferably below 0.1%. The amount of available oxygen in the liquid phase corresponds to not more than one fifth of the total amount of peroxygen bleach in the composition, preferably to not more than one tenth.

BACKGROUND

So-called heavy duty liquid detergent compositions commercially available at present typically comprise organic surfactants, enzymes, and perfumes. These components are generally incompatible with peroxygen bleaches. As a result, no peroxygen bleach containing liquid detergent compositions are commercially available to date.

European Patent 0,037,184, granted Jan. 23, 1985 to Interox Chemicals Ltd, discloses liquid detergent compositions comprising organic surfactants, a builder system, at least 2% hydrogen peroxide and a stabilizing system comprising an aminoethylene phosphonate or hydroxyalkyl diphosphonate, a polyhydroxyaliphatic carboxylate, and/or a low melecular weight monohydroxy aliphatic alcohol.

European Patent 0,086,511, granted Jul. 2, 1986 to The Procter & Gamble Company, discloses aqueous liquid detergent compositions having a pH below 9 and comprising organic surfactants, oxygen bleach, fatty acid and a water-soluble calcium salt.

DE-OS 35 11 515, published Oct. 17, 1985, discloses non-aqueous liquid detergent compositions comprising sodiumperborate monohydrate and an activator for the perborate. FR 2.579.615, published Oct. 3, 1986, discloses similar non-aqueous compositions which further comprise catalase inhibitors. The compositions exemplified in these two patents do not contain anionic surfactants.

It is an object of the present invention to provide aqueous liquid detergent compositions containing substantial amounts of a solid, water-soluble peroxygen bleach. It is a further object of the present invention to provide such bleach-containing liquid detergent compositions that contain substantial amounts of anionic surfactant.

SUMMARY OF THE INVENTION

The liquid detergent compositions of the present invention have a pH of at least 8, which comprise organic surfactants and which further comprise, by weight of the composition, an amount of a solid water-soluble peroxygen compound dispersed in a liquid phase which comprises a solvent system comprising water and at least one water-miscible organic solvent, such that the amount of available oxygen (AVO) dissolved in the liquid phase is not greater than 0.5%, preferably not greater than 0.1%, by weight of the liquid phase. The amount of available oxygen dissolved in the liquid phase corresponds to not more than one fifth of the amount of peroxygen compound of the composition, preferably to not more than one tenth.

Preferred herein are detergent compositions having a pH of at least 9, more preferably at least 9.5.

The preferred solid, water-soluble peroxygen compounds are the perborates. The preferred water-miscible organic solvents are the low molecular weight monohydric alcohols; the most preferred of these solvents is ethanol.

Preferred are also liquid detergent compositions that further comprise detergent enzymes.

DETAILED DESCRIPTION OF THE INVENTION

The present invention addresses the problem of formulating a liquid detergent composition that contains significant amounts of organic surfactant, including anionic surfactants, and of a solid, water-soluble peroxygen bleach, and that is stable. It has now been discovered that this may be achieved by the use of a solvent system that comprises water and a water-miscible organic solvent. This makes it possible to incoporate in the liquid detergent composition a significant amount of the peroxygen compound, while keeping the amount of available oxygen in solution below 0.5% by weight of the solvent system, preferably below 0.1%. Less than 1/5 of the peroxygen compound is dissolved in the liquid phase, preferably less than 1/10.

The presence of water in the solvent system is essential for the solubility of, e.g. anionic surfactants. The low level of available oxygen in solution has been found to result in a bleach system that is stable upon storage under typical storage conditions.

The liquid detergent compositions are formulated at a pH of at least 8, preferably of at least 9, more preferably at least 9.5. The alkaline pH is conducive to a good bleaching action of the peroxygen compound, particularly when the peroxygen compound is a per-borate. Nevertheless, the stability of the bleach system in an aqueous liquid of alkaline pH is surprising. At least some of the available oxygen in solution is assumed to be present in the form of hydrogen peroxide. It has been found that hydrogen peroxide is not sufficiently stable in the solvent systems of the liquid detergent compositions of the present invention. Yet, the solid, water-soluble peroxygen bleaches have been found to be stable therein. Apparently, the low level of available oxygen in solution is critical for the stability of the system.

Examples of suitable water-soluble solid peroxygen compounds include the perborates, persulfates, peroxydisulfates, perphosphates and the crystalline peroxyhydrates formed by reacting hydrogen peroxide with sodium carbonate or urea. Preferred peroxygen bleach compounds are sodium perborate monohydrate and sodium) perborate tetrahydrate.

The standard iodometric method (as described for instance in Methoden der Organischen Chemie, Houben Weyl, 1953, Vo. 2, page 562) is suitable to determine the available oxygen (AVO) content of the composition.

In order to ensure complete equilibration between liquid and solid phases, the compositions are to be kept after mixing for three days at room temperature before the AVO titration. Before measuring the products are thoroughly shaken in order to ensure correct sampling, For the determination of the available oxygen (AVO) in the liquid phase, samples of the compositions are centrifuged for 10 minutes at 10.000 rpm. The liquid is then separated from the solid and titrated for available oxygen.

It is not necessary that the organic solvent be fully miscible with water, provided that enough of the solvent mixes with the water of the composition to affect the solubility of the peroxygen compound in the described manner. Fully water-soluble solvents are preferred for use herein.

The water-miscible organic solvent must, of course, be compatible with the peroxygen bleach compound at the pH that is used. Therefore, polyalcohols having vicinal hydroxy groups (e.g. 1,2-propanediol and glycerol) are less desirable when the peroxygen bleach compound is perborate.

Examples of suitable water-miscible organic solvents include the lower aliphatic monoalcohols; ethers of diethylene glycol and lower monoaliphatic monoalcohols; specifically ethanol, n-propanol; iso-propanol; butanol; polyethylene glycol (e.g., PEG 150, 200, 300, 400); dipropylene glycol; hexylene glycol; methoxyethanol; ethoxyethanol; butoxyethanol; ethyldiglycolether; benzylalcohol; butoxypropanol; butoxypropoxypropanol; and mixtures thereof. Preferred solvents include ethanol; iso-propanol, 1-methoxy2-propanol and butyldiglycolether. A preferred solvent system comprises ethanol, and a co-solvent having a higher flashpoint than ethanol.

Although the presence or absence of other ingredients plays a role, the amount of available oxygen in solution is largely determined by the ratio water:organic solvent. The smaller this ratio (i.e. the more organic solvent is used in the solvent sytem), the lower the amount of available oxygen in solution. Although this is good for stability of the bleach system, it is less desirable for a good solubility of other components (e.g. electrolyte, anionic surfactants). In any event, it is not necessary to use more organic solvent than is needed to keep the amount of available oxygen in solution below 0.5%, preferably below 0.1%.

In practical terms, the ratio water:organic solvent is, for most systems, in the range from 8:1 to 1:3, preferably from 5:1 to 1:2.

The liquid detergent compositions herein contain from 5% to 60% of the liquid detergent composition, preferably from 15% to 40% of an organic surface-active agent selected from nonionic, anionic, and zwitterionic surface-active agents and mixtures thereof.

Synthetic anionic surfactants can be represented by the general formula $R^1SO^3M$ wherein $R^1$ represents a hydrocarbon group selected from the group consisting of straight or branched alkyl radicals containing from about 8 to about 24 carbon atoms and alkyl phenyl radicals containing from about 9 to about 15 carbon atoms in the alkyl group. M is a salt forming cation which typically is selected from the group consisting of sodium, potassium, ammonium, and mixtures thereof.

A preferred synthetic anionic surfactant is a water-soluble salt of an alkylbenzene sulfonic acid containing from 9 to 15 carbon atoms in the alkyl group. Another preferred synthetic anionic surfactant is a water-soluble salt of an alkyl sulfate or an alkyl polyethoxylate ether sulfate wherein the alkyl group contains from about 8 to about 24, preferably from about 10 to about 18 carbon atoms and there are from about 1 to about 20, preferably from about 1 to about 12 ethoxy groups. Other suitable anionic surfactants are disclosed in U.S. Pat. No. 4,170,565, Flesher et al., issued Oct. 9, 1979.

The nonionic surfactants are conventionally produced by condensing ethylene oxide with a hydrocarbon having a reactive hydrogen atom, e.g., a hydroxyl, carboxyl, or amido group, in the presence of an acidic or basic catalyst, and include compounds having the general formula $RA(CH_2CH_2O)_nH$ wherein R represents the hydrophobic moiety, A represents the group carrying the reactive hydrogen atom and n represents the average number of ethylene oxide moieties. R typically contains from about 8 to 22 carbon atoms. They can also be formed by the condensation of propylene oxide with a lower molecular weight compound. n usually varies from about 2 to about 24.

The hydrophobic moiety of the nonionic compound is preferably a primary or secondary, straight or branched, aliphatic alcohol having from about 8 to about 24, preferably from about 12 to about 20 carbon atoms. A more complete disclosure of suitable nonionic surfactants can be found in U.S. Pat. No. 4,111,855. Mixtures of nonionic surfactants can be desirable.

Zwitterionic surfactants include derivatives of aliphatic quaternary ammonium, phosphonium, and sulphonium compounds in which the aliphatic moiety can be straight or branched chain and wherein one of the aliphatic substituents contains from about 8 to about 24 carbon atoms and another substituent contains, at least, an anionic water-solubilizing group. Particularly preferred zwitterionic materials are the ethoxylated ammonium sulfonates and sulfates disclosed in U.S. Pat. Nos. 3,925,262, Laughlin et al., issued Dec. 9, 1975 and 3,929,678, Laughlin et al., issued Dec. 30, 1975.

Semi-polar nonionic surfactants include water-soluble amine oxides containing one alkyl or hydroxy alkyl moiety of from about 8 to about 28 carbon atoms and two moieties selected from the group consisting of alkyl groups and hydroxy alkyl groups, containing from 1 to about 3 carbon atoms which can optionally be joined into ring structures.

Suitable anionic synthetic surface-active salts are selected from the group of sulfonates and sulfates. The like anionic detergents are well-known in the detergent arts and have found wide-spread application in commercial detergents. Preferred anionic synthetic water-soluble sulfonate or sulfate salts have in their molecular structure an alkyl radical containing from about 8 to about 22 carbon atoms.

Examples of such preferred anionic surfactant salts are the reaction products obtained by sulfating $C_8$–$C_{18}$ fatty alcohols derived from tallow and coconut oil; alkylbenzene sulfonates wherein the alkyl group contains from about 9 to 15 carbon atoms; sodium alkylglyceryl ether sulfonates; ether sulfates of fatty alcohols derived from tallow and coconut oils; coconut fatty acid monoglyceride sulfates and sulfonates; and water-soluble salts of paraffin sulfonates having from about 8 to about 22 carbon atoms in the alkyl chain. Sulfonated olefin surfactants as more fully described in e.g. U.S. patent specification 3,332,880 can also be used. The neutralizing cation for the anionic synthetic sulfonates and/or sulfates is represented by conventional cations which are widely used in detergent technology such as sodium and potassium.

A particularly preferred anionic synthetic surfactant component herein is represented by the water-soluble salts of an alkylbenzene sulfonic acid, preferably sodium alkylbenzene sulfonates having from about 10 to 13 carbon atoms in the alkyl group.

A preferred class of nonionic ethoxylates is represented by the condensation product of a fatty alcohol having from 12 to 15 carbon atoms and from about 4 to 10 moles of ethylene oxide per mole of fatty alcohol. Suitable species of this class of ethoxylates include: the condensation product of $C_{12}$–$C_{15}$ oxo-alcohols and 7 moles of ethylene oxide per mole of alcohol; the condensation product of narrow cut $C_{14}$–$C_{15}$ oxo-alcohols and 7 or 9 moles of ethylene oxide per mole of fatty(oxo)alcohol; the condensation product of a narrow cut $C_{12}$–$C_{13}$ fatty(oxo) alcohol and 6,5 moles of ethylene oxide per mole of fatty alcohol; and the condensation products of a $C_{10}$–$C_{14}$ coconut fatty alochol with a degree of ethoxylation (moles EO/mole fatty alcohol) in the range from 5 to 8. The fatty oxo alcohols while mainly linear can have, depending upon the processing conditions and raw material olefins, a certain degree of branching, particularly short chain such as methyl branching.

A degree of branching in the range from 15% to 50% (weight %) is frequently found in commercial oxo alcohols.

Preferred nonionic ethoxylated components can also be represented by a mixture of 2 separately ethoxylated nonionic surfactants having a different degree of ethoxylation. For example, the nonionic ethoxylate surfactant containing from 3 to 7 moles of ethylene oxide per mole of hydrophobic moiety and a second ethoxylated species having from 8 to 14 moles of ethylene oxide per mole of hydrophobic moiety. A preferred nonionic ethoxylated mixture contains a lower ethoxylate which is the condensation product of a $C_{12}$–$C_{15}$ oxo-alcohol, with up to 50% (wt) branching, and from about 3 to 7 moles of ethylene oxide per mole of fatty oxo-alcohol, and a higher ethoxylate which is the condensation product of a $C_{16}$–$C_{19}$ oxo-alcohol with more than 50% (wt) branching and from about 8 to 14 moles of ethylene oxide per mole of branched oxo-alcohol.

The liquid detergent compositions herein optionally contain a cationic surfactant, preferably from 0.1% to 4% by weight of the composition.

Examples of suitable cationic surfactants include quaternary ammonium compounds of the formula $R_1 R_2 R_3 R_4 N^+X^-$, wherein $R_1$ is $C_{12}$–$C_{20}$ alkyl or hydroxyalkyl; $R_2$ is $C_1$–$C_4$ alkyl or $C_{12}$–$C_{20}$ alkyl or hydroxyalkyl or $C_1$–$C_4$ hydroxyalkyl; $R_3$ and $R_4$ are each $C_1$–$C_4$ alkyl or hydroxyalkyl, or $C_6$–$C_8$ aryl or alkylaryl ; and $X^-$ is halogen. Preferred are mono-long chain quaternary ammonium compounds (i.e., compounds of the above formula wherein $R_2$ is $C_1$–$C_4$ alkyl or hydroxyalkyl).

The liquid detergent compositions herein optionally contain, as a builder, a fatty acid component. Preferably, however, the amount of fatty acid is less than 5% by weight of the composition, more preferably less than 4%. Preferred saturated fatty acids have from 10 to 16, more preferably 12 or 14 carbon atoms. Preferred unsaturated fatty acids are oleic acid and palmitoleic acid.

Detergent enzymes can be used in the liquid detergent compositions of this invention. In fact, one of the desirable features of the present compositions is that they are compatible with such detergent enzymes. Suitable enzymes include the detergent proteases, amylases, lipases and cellulases. Enzymatic stabilizing agents for use in aqueous liquid detergents are well known. Preferred herein is a salt of formic acid, e.g., sodium formate. The amount of this stabilizing agent typically ranges from 0.5% to 2%.

Preferred compositions contain an inorganic or organic builder. Examples of inorganic builders include the phosphorous-based builders, e.g., sodium tripolyphosphate, sodium pyrophosphate, and aluminosilicates (zeolites).

Examples of organic builders are represented by polyacids such as citric acid, nitrilotriacetic acid, and mixtures of tartrate monosuccinate with tartrate disuccinate. Preferred builders for use herein are citric acid and alk(en)yl-substituted succinic acid compounds, wherein alk(en)yl contains from 10 to 16 carbon atoms. An example of this group of compounds is dodecenyl succinic acid. Polymeric carboxylate builders inclusive of polyacrylates, polyhydroxy acrylates and polyacrylates/polymaleates copolymers can also be used.

The compositions herein can contain a series of further optional ingredients which are mostly used in additive levels, usually below about 5%. Examples of the like additives include: polyacids, enzymes and enzymatic stabilizing agents, suds regulants, opacifiers, agents to improve the machine compatibility in relation to enamel-coated surfaces, bactericides, dyes, perfumes, brighteners and the like.

The liquid compositions herein can contain further additives of a level from 0.05 to 2%.

These additives include polyaminocarboxylates such as ethylenediaminotetracetic acid, diethylenetriaminopentacetic acid, ethylenediamino disuccinic acid or the water-soluble alkali metals thereof. Other additives include organo-phosphonic acids; particularly preferred are ethylenediamino tetramethylenephosphonic acid, hexamethylenediamino tetramethylenephosphonic acid, diethylenetriamino pentamethylenephosphonic acid and aminotrimethylenephosphonic acid.

Bleach stabilizers such as ascorbic acid, dipicolinic acid, sodium stannates and 8-hydroxyquinoline can also be included in these compositions, at levels between 0.01 and 1%.

The beneficial utilization of the claimed compositions under various usage conditions can require the utilization of a suds regulant. While generally all detergent suds regulants can be utilized preferred for use herein are alkylated polysiloxanes such as dimethylpolysiloxane also frequently termed silicones. The silicones are frequently used in a level not exceeding 1.5%, most preferably between 0.1% and 1.0%.

It can also be desirable to utilize opacifiers inasmuch as they contribute to create a uniform appearance of the concentrated liquid detergent compositions. Examples of suitable opacifiers include: polystyrene commercially known as LYTRON 621 manufactured by MONSANTO CHEMICAL CORPORATION. The opacifiers are frequently used in an amount from 0.3% to 1.5%.

The liquid detergent compositions of this invention further can comprise an agent to improve the washing machine compatibility, particularly in relation to enamel-coated surfaces.

It can further be desirable to add from 0.1% to 5% of known antiredeposition and/or compatibilizing agents. Examples of the like additives include: sodium carboxymethylcellulose; hydroxy-$C_{1-6}$-alkylcellulose; polycarboxylic homo- or copolymeric ingredients, such as: polymaleic acid; a copolymer of maleic anhydride and methylvinylether in a molar ratio of 2:1 to 1:2; and a copolymer of an ethylenically unsaturated monocarboxylic acid monomer, having not more than 5, preferably 3 or 4 carbon atoms, for example(meth)acrylic acid, and an ethylenically unsaturated dicarboxylic acid monomer having not more than 6, preferably 4 carbon atoms, whereby the molar ratio of the monomers is in the range from 1:4 to 4:1, said copolymer being described in more detail in EUROPEAN Patent Application 0 066 915, filed May 17, 1982.

The physical stability of the liquid detergent compositions is enhanced by the addition of small amounts of $C_{18}$–$C_{22}$ saturated fatty acid soaps or derivatives of such fatty acids, like esters or amides, Preferred are alkali metal soaps of $C_{18}$–$C_{22}$ fatty acids, typically from 0.1% to 2%. A suitable example is sodium stearate.

The following examples illustrate the invention and facilitates its understanding.

Liquid detergent compositions are prepared by mixing the listed ingredients in the stated proportions:

| Ingredients | Composition (weight %) | | | | |
|---|---|---|---|---|---|
| | I | II | III | IV | V |
| Water | 33 | 32 | 26 | 23 | 34 |
| Ethanol | 14 | 15 | 18 | 22 | 11 |
| Linear dodecylbenzene sulfonic acid | 12 | 10 | 8 | 8 | 12 |
| Condensation product of 1 mole of C13–C15 oxo alcohol and 7 moles of ethylene oxide | 7 | 9 | 10 | 8 | 7 |
| Sodium cocoyl sulfate | 2 | 3 | 4 | 2 | 2 |
| Dodecenyl succinic acid | 13 | 10 | 12 | 15 | 13 |
| Citric acid | 0.8 | 1 | 1 | 0.8 | 0.8 |
| Oleic acid | 3.3 | 4 | 3 | 2 | 3.3 |
| Protease | 0.3 | 0.5 | — | 0.5 | — |
| Diethylenetriamine pentamethylene phosphonic acid | 0.05 | 0.85 | 0.05 | 0.05 | 0.05 |
| Sodium formate | 0.9 | 1 | — | 1 | — |
| Sodium perborate monohydrate | 10 | 10 | 12 | 10 | 10*) |
| Sodium hydroxide (to adjust to) pH | 9 | 10 | 9 | 11 | 8.2 |
| Perfume, minors | balance | | | | |

*)sodium perborate tetrahydrate

| Ingredients | Composition (weight %) | | | | | | |
|---|---|---|---|---|---|---|---|
| | VI | VII | VIII | IX | X | XI | XII |
| Water | 31 | 28 | 27 | 32 | 23 | 28 | 22 |
| Ethanol | 6.5 | — | 7 | 5 | 6 | 7 | 8 |
| 1-Methoxy-2-propanol | — | 14 | 3.5 | — | — | 7 | 7 |
| Isopropanol | 6.5 | — | — | — | 6 | — | — |
| Butyldiglycolether | — | — | 4.0 | 5 | — | — | — |
| Linear dodecylbenzene sulfonic acid | 11.4 | 12 | 7 | 13 | 12 | 10 | 9 |
| Nonionic surfactant | 7.2 | 7 | 11 | 3.5 | 6 | 8 | 7 |
| Sodium cocoyl-sulfate | 3.1 | 2.5 | 2.5 | 3.0 | 4.0 | 3.0 | 2.0 |
| TMS/TDS * | — | — | — | — | — | 6.5 | 3.5 |
| Dodecenyl succinic acid | 13.4 | 9 | — | — | 7 | 8.5 | 9.5 |
| Tetradecenyl-succinic acid | — | 4 | — | — | — | — | 1.0 |
| Coconut fatty acid | — | — | 16 | 1.0 | 1.0 | — | — |
| Oleic acid | 3.6 | 3.6 | 4.0 | 2.0 | 3.0 | 2.0 | 2.5 |
| Citric acid | 0.8 | 0.9 | 0.5 | — | 3.5 | — | 0.5 |
| DTPMPA ** | 0.9 | 0.5 | 0.5 | — | 0.4 | 0.8 | 1.5 |
| Ethylene diamine tetraacetic acid | — | — | — | 1.0 | 0.4 | — | — |
| Sodium tripoly-phosphate | — | — | — | 15.0 | — | — | — |
| Sodium perborate tetrahydrate | — | — | — | — | 17 | — | — |
| Sodium perborate monohydrate | 9.0 | 10.4 | 9 | 13 | — | 13 | 19 |
| Sodium formate | 0.9 | 0.8 | 1.0 | 1.0 | 1.5 | 0.5 | 1.0 |
| Protease | 0.7 | 0.6 | 0.8 | 0.5 | 1.0 | 0.5 | 0.6 |
| Sodium hydroxide | 9 | 10 | 11 | 11 | 9.5 | 10.5 | 10.5 |

-continued

| Ingredients | Composition (weight %) | | | | | | |
|---|---|---|---|---|---|---|---|
| | VI | VII | VIII | IX | X | XI | XII |
| to pH | | | | | | | |
| Perfume, minors | balance | | | | | | |

* 80:20 mixture of tartrate monosuccinate and tartrate disuccinate
** Diethylenetriamino pentamethylene phosphonic acid

| Ingredients | Composition (weight %) | | | | | |
|---|---|---|---|---|---|---|
| | XIII | XIV | XV | XVI | XVII | XVIII |
| water | 27 | 27 | 27 | 24 | 23.5 | 25 |
| ethanol | 13 | 8 | 10 | 13 | 13 | 10 |
| co-solvent 1) | — | 5 | 3 | — | — | 3 |
| linear dodecylbenzene sulfonic acid | 9 | 9 | 9 | 9 | 9 | 9 |
| condensation product of 1 mole of $C_{13}$–$C_{15}$ oxo alcohol and 7 moles of ethylene oxide | 7 | 7 | 7 | 7 | 7 | 7 |
| sodium cocoyl sulfate | 1 | 1 | 1 | 1 | 1 | 1 |
| dodecenyl succinic acid | 13 | 13 | 13 | 13 | 13 | 13 |
| citric acid | 0.8 | 0.8 | 0.8 | 0.8 | 0.8 | 0.8 |
| oleic acid | 3 | 3 | 3 | 3 | 3 | 3 |
| protease | 0.8 | 0.5 | 0.5 | 0.5 | 0.5 | 0.5 |
| diethylene triamine pentamethylene phosphonic acid | 0.7 | 0.7 | 0.7 | 0.7 | 0.7 | 0.7 |
| sodium stearate | — | — | 0.3 | 1.0 | 1.5 | 0.6 |
| sodium formate | 1.0 | 1.0 | 1.0 | 1.0 | 1.0 | 1.0 |
| sodium perborate monohydrate | 14.0 | 14.0 | 14.0 | 14.0 | 14.0 | 14.0 |
| $C_{12}$–$C_{14}$ trimethyl ammonium chloride | — | — | — | 2.0 | — | — |
| $C_{12}$–$C_{14}$ (2-hydroxy-ethyl) dimethyl ammonium chloride | — | — | — | — | 2.0 | — |
| $C_{18}$(2-hydroxyethyl) dimethyl ammonium chloride | — | — | — | — | — | 2.0 |
| Sodium hydroxide (to adjust to) pH | 10 | 10 | 10 | 10 | 10 | 10 |
| Perfume, minors | balance | | | | | |

1) selected from = PEG 150, 200, 300, 400//dipropyleneglycol, hexyleneglycol, n-propanol, iso-propanol, Methoxyethanol, Ethoxyethanol, Butoxyethanol, Ethyldiglycol, Butydiglycolether, Benzylalcohol, Butoxypropanol, ButoxyPropoxypropanol.

We claim:

1. A liquid, bleach containing detergent composition comprising anionic surfactants and having a pH of at least 9.5, said composition comprising, by weight of the composition, an amount of a solid, water-soluble peroxygen compound, suspended in a liquid phase which comprises a solvent system comprising water and at least one lower aliphatic monoalcohol water-miscible organic solvent wherein the ratio of water to water-miscible organic solvent is from 5:1 to 1:2, characterized in that an amount of available oxygen is dissolved in the liquid phase which is not greater than 0.5% by weight of the liquid phase and corresponds to not more than one fifth of the amount of peroxygen compound of the composition.

2. A liquid detergent composition according to claim 1 wherein the amount of available oxygen dissolved in the liquid phase corresponds to not more than one tenth of the amount of peroxygen compound.

3. A liquid detergent composition according to claim 1, wherein the water-miscible organic solvent is ethanol.

4. A liquid detergent composition according to claim 1, wherein the solid, water-soluble peroxygen compound is a perborate.

5. A liquid detergent composition according to claim 1 containing less than 4% fatty acid.

6. A liquid detergent according to claim 1 composition comprising, from 5% to 40% of a builder selected from dodecenyl succinic acid; tetradecenyl succinic acid; dodecyl succinic acid; an 80:20 mixture of tartrate monosuccinate and tartrate disuccinate; citric acid; and mixtures thereof.

* * * * *